US009305720B2

(12) United States Patent
Chen et al.

(10) Patent No.: US 9,305,720 B2
(45) Date of Patent: Apr. 5, 2016

(54) ELECTRICAL SIGNAL SWITCH CONNECTOR STRUCTURE

(71) Applicant: SPEED TECH CORP., Taoyuan Hsien (TW)

(72) Inventors: Chih-Cheng Chen, Taoyuan Hsien (TW); Chen-Hung Sung, Taoyuan Hsien (TW); Hei-Hsueh Chiang, Taoyuan Hsien (TW)

(73) Assignee: SPEED TECH CORP., Taoyuan (TW)

( * ) Notice: Subject to any disclaimer, the term of this patent is extended or adjusted under 35 U.S.C. 154(b) by 287 days.

(21) Appl. No.: 13/896,337

(22) Filed: May 17, 2013

(65) Prior Publication Data

US 2013/0319834 A1 Dec. 5, 2013

(30) Foreign Application Priority Data

May 29, 2012 (TW) ..... 101210290 U
Mar. 27, 2013 (TW) ..... 102205818 U

(51) Int. Cl.
*H01H 9/02* (2006.01)
*H01R 24/46* (2011.01)
*H01R 24/50* (2011.01)

(52) U.S. Cl.
CPC ..... *H01H 9/02* (2013.01); *H01R 24/46* (2013.01); *H01R 24/50* (2013.01)

(58) Field of Classification Search
CPC ..... H01R 24/46; H01R 24/50; H01R 13/703; H01R 12/00; H01R 12/51; H01H 9/02
USPC ..... 200/259, 295; 439/63, 188, 578
See application file for complete search history.

(56) References Cited

U.S. PATENT DOCUMENTS 6,808,405 B1 10/2004 Uratani et al.
8,066,516 B2 * 11/2011 Hoshiba et al. ..... 439/63

FOREIGN PATENT DOCUMENTS

TW M336603 7/2008
TW 201036284 10/2010

* cited by examiner

*Primary Examiner* — Amy Cohen Johnson
*Assistant Examiner* — Marina Fishman
(74) *Attorney, Agent, or Firm* — CKC & Partners Co., Ltd.

(57) ABSTRACT

An electrical signal switch connector structure is provided, mainly including an insulating case, an elastic terminal, a fixing terminal, and a shielding case. The insulating case respectively accommodates the elastic terminal and the fixing terminal. The elastic terminal has an elastic arm, and the elastic arm of the elastic terminal has a cutting gap. The fixing terminal has a fixing arm, and the elastic arm of the elastic terminal is elastically pressed against the fixing arm of the fixing terminal. An inlet hole of the insulating case is used for passing a terminal of a butting connector therein, and the shielding case wraps the insulating case profile such that an ambient extraneous matter is not attached to the elastic arm of the elastic terminal.

11 Claims, 12 Drawing Sheets

ELECTRICAL SIGNAL SWITCH CONNECTOR STRUCTURE

RELATED APPLICATIONS

This application claims priority to Taiwan Application Serial Number 101210290, filed May 29, 2012, and Taiwan Application Serial Number 102205818, filed Mar. 27, 2013, which are herein incorporated by reference.

BACKGROUND

1. Technical Field

The utility model relates to an electrical signal switch connector structure, and particularly relates to an electrical signal switch connector structure which is capable of switching a transmission path of a high-frequency electrical signal.

2. Description of Related Art

Generally, after an electronic device is integrally assembled, final function tests for each part of the electronic device are implemented. Such tests are typically required to efficiently detect functions of each part of the device as comprehensive as possible during a short time. Furthermore, a change-over switch is used for changing a transmission path of an electrical signal during the tests in order to check whether circuits of each part of the electronic device can achieve expected functions. In respect of a high-frequency electronic device, such as a mobile phone, the final function tests may be implemented on a basis of random samples, but for the purpose of reducing the test distortion and simplifying the test work, each of these electronic devices is mounted with at least one high-frequency electrical signal switch connector so as to deduce samples that are not sampled. Prior art disclosing related information of such a high-frequency electrical signal coaxial change-over switch can be referred in the U.S. Pat. No. 6,808,405 and Taiwan Invention Patent Publication No. TW201036284, and the like.

As illustrated in FIG. 9 and FIG. 9A, an electrical signal switch connector structure is disclosed in Taiwan Utility Model Patent No. M336603. An elastic terminal B and a fixing terminal C are accommodated in the connector by an insulating case A. The elastic terminal B and the fixing terminal C are held on stable positions of the insulating case A. In addition, a shielding case D covers and is attached to the insulating case A, and is utilized to provide the insulating case A with good electromagnetic shielding protection, so as to reduce interference arising from mutual induction between external and internal electromagnetic fields of the insulating case A.

The elastic terminal B has a main part B1. An elastic arm B2 and a weld part B3 respectively extend from two ends of the main part B1 of the elastic terminal B, and the elastic arm B2 of the elastic terminal B is an elastic metal cantilever. The fixing terminal C also has a main part C1, and a fixing arm C2 and a weld part C3 respectively extend from two ends of the main part C1 of the fixing terminal C. The insulating case A has an elastic terminal accommodation chamber A1 and a fixing terminal accommodation chamber A2. The elastic terminal accommodation chamber A1 of the insulating case A can accommodate the main part B1 of the elastic terminal B, and the fixing terminal accommodation chamber A2 of the insulating case A can accommodate the main part C1 of the fixing terminal C, such that the elastic terminal B and the fixing terminal C can be fixed on the positions inside the insulating case A. The weld part B3 of the elastic terminal B and the weld part C3 of the fixing terminal C outwardly extend from the insulating case A to a circuit board (not illustrated in FIG. 9 and FIG. 9A) such that the weld part B3 of the elastic terminal B and the weld part C3 of the fixing terminal C can be respectively electrically connected with different contacts on the circuit board.

The elastic arm B2 of the elastic terminal B is normally pressed against the lower edge of the fixing arm C2 of the fixing terminal C, such that the elastic terminal B can be normally electrically connected with the fixing terminal C. An inlet hole A3 is set up on the insulating case A. The inlet hole A3 of the insulating case A is used to accommodate a butting connector of the test device (not illustrated in FIG. 9 and FIG. 9A) or to let a test probe E pass through such that the probe E can enter the inlet hole A3 of the insulating case A and push down the elastic arm B2 of the elastic terminal B, and then break the normal electrical connection status between the elastic terminal B and the fixing terminal C.

As illustrated in FIG. 10 and FIG. 10A, a switch-equipped coaxial connector and an assembly method thereof are disclosed in Taiwan Invention Patent Publication No. TW201036284. An elastic terminal B and a fixing terminal C are accommodated in the connector by an insulating case A. The elastic terminal B and the fixing terminal C are held on stable positions of the insulating case A. In addition, a shielding case D covers and is attached to the insulating case A, and is utilized to provide the insulating case A with good electromagnetic shielding protection, so as to reduce interference arising from mutual induction between external and internal electromagnetic fields of the insulating case A.

The elastic terminal B has a main part B1. An elastic arm B2 and a weld part B3 respectively extend from two ends of the main part B1 of the elastic terminal B, and the elastic arm B2 of the elastic terminal B is an elastic metal cantilever. The fixing terminal C also has a main part C1, and a fixing arm C2 and a weld part C3 respectively extend from two ends of the main part C1 of the fixing terminal C. The insulating case A has an elastic terminal accommodation chamber A1 and a fixing terminal accommodation chamber A2. The elastic terminal accommodation chamber A1 of the insulating case A can accommodate the main part B1 of the elastic terminal B, and the fixing terminal accommodation chamber A2 of the insulating case A can accommodate the main part C1 of the fixing terminal C, such that the elastic terminal B and the fixing terminal C can be fixed on the positions inside the insulating case A. The weld part B3 of the elastic terminal B and the weld part C3 of the fixing terminal C outwardly extend from the insulating case A to a circuit board (not illustrated in FIG. 10 and FIG. 10A) such that the weld part B3 of the elastic terminal B and the weld part C3 of the fixing terminal C can be respectively electrically connected with different contacts on the circuit board.

The elastic arm B2 of the elastic terminal B is normally pressed against the lower edge of the fixing arm C2 of the fixing terminal C, such that the elastic terminal B can be normally electrically connected with the fixing terminal C. An inlet hole A3 is set up on the insulating case A. The inlet hole A3 of the insulating case A is used to accommodate a butting connector of the test device or to let a test probe E (both not illustrated in FIG. 10 and FIG. 10A) pass through such that the probe E can enter the inlet hole A3 of the insulating case A and push down the elastic arm B2 of the elastic terminal B, and then break the normal electrical connection status between the elastic terminal B and the fixing terminal C.

Since a general coaxial switch connector has a very tiny overall volume and is commonly used to transmit high-frequency electrical signals, once an extraneous matter in the production environment or test environment intrude into the connector, the transmission of the high-frequency electrical signals is possibly affected. The ambient extraneous matter intruding into the connector (not illustrated in FIG. 10 and FIG. 10A) might be tin solder used for welding terminals, plastic dust, or metal scraps. These ambient extraneous matters may result in that the elastic terminal B cannot be electrically disconnected with the fixing terminal C or the both be normally disconnected, which leads to the failure of the coaxial switch. As illustrated in FIG. 9 and FIG. 10, for preventing the extraneous matters from intruding into the connector, according to the taught of the prior art, a pressing part A4 extends from a proper position of the insulating case A, and a dent D1 is formed on the profile of the shielding case D when the shielding case D is assembled outside the insulating case A. This makes the dent D1 on the shielding case D force the pressing part A4 of the insulating case A to deform, due to which a gap between the elastic terminal B and the elastic terminal accommodation chamber A1 is closed, such that the ambient extraneous matters cannot be attached on the elastic arm B2 of the elastic terminal B.

The prior art refers to closing the gap between the insulating case A and the elastic terminal B to prevent ambient extraneous matters from intruding into the connector. However, the prior art ignores the possibility that the ambient extraneous matters more likely intrude into the insulating case A from the inlet hole A3 of the insulating case A, and additionally, once the pressing part A4 of the insulating case A breaks, the elastic terminal B would accidently contact the shielding case D. Therefore, improvement for the prior art is necessary.

SUMMARY

The disclosure mainly provides an electrical signal switch connector structure. The connector structure is suitable for a switch connector with tiny volume, and particularly is suitable for a connector with appearance sizes of each part not more than 3.5 mm.

An electrical signal switch connector structure is disclosed, mainly including an insulating case, an elastic terminal, a fixing terminal, and a shielding case. The insulating case is a three-dimensional spatial entity having a plurality of surfaces. An inlet hole is set up on one surface of the insulating case for passing through a butting connector or a part of a probe. Two surfaces adjacent to the inlet hole of the insulating case respectively have a first opening and a second opening. An elastic terminal accommodation chamber and a fixing terminal accommodation chamber respectively extend from the first opening and the second opening to the inlet hole of the insulating case, such that the inlet hole of the insulating case, the elastic terminal accommodation chamber and the fixing terminal accommodation chamber are communicated. The elastic terminal accommodation chamber and the fixing terminal accommodation chamber of the insulating case respectively accommodate the elastic terminal and the fixing terminal. The elastic terminal has an elastic arm that is elastically pressed against the fixing terminal, and the elastic terminal and the fixing terminal respectively have a weld part extending out of the insulating case. The shielding case mainly covers the surface of the insulating case that has the inlet hole, and the insulating case is surrounded by the shielding case.

DETAILED DESCRIPTION

Figure 1:
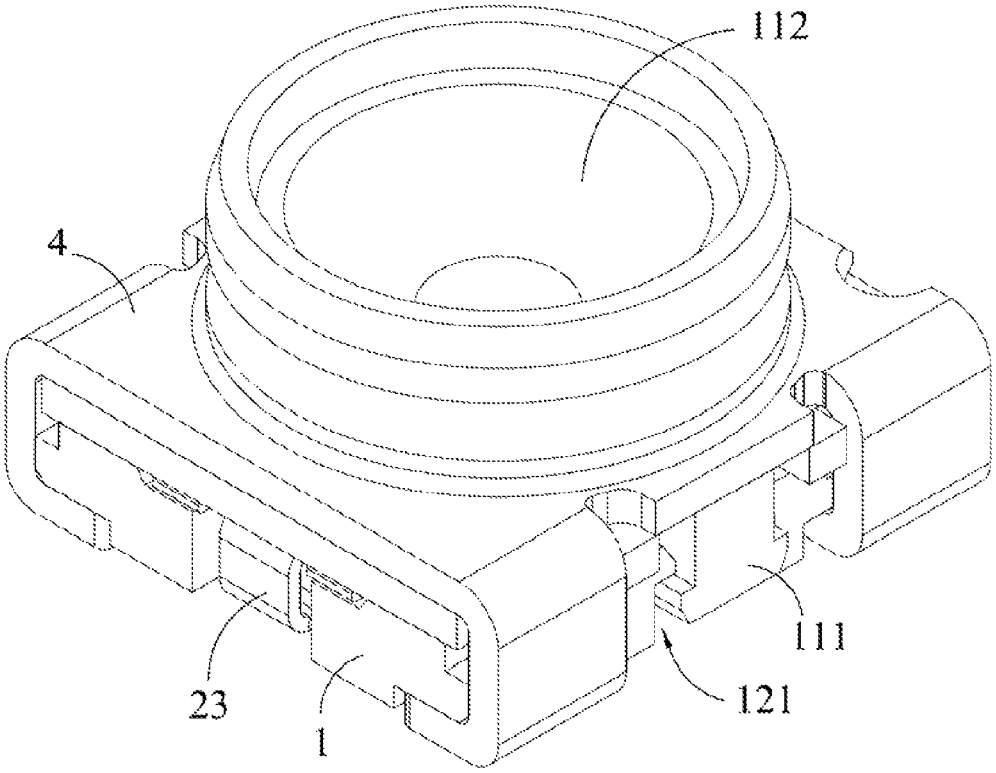
FIG. 1 is a perspective appearance view of a first embodiment of the disclosure.
Figure 2:
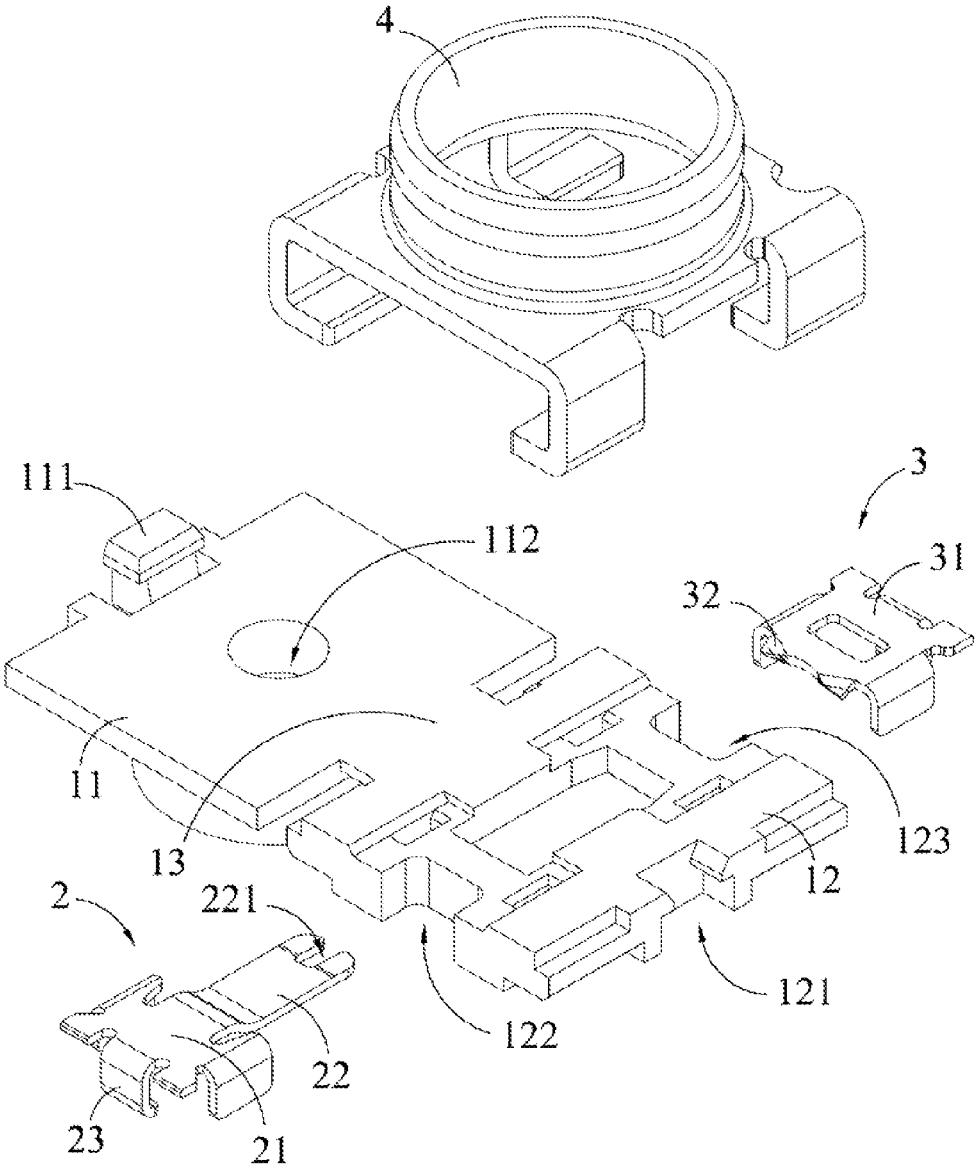
FIG. 2 is an exploded view of FIG. 1.
Figure 3:
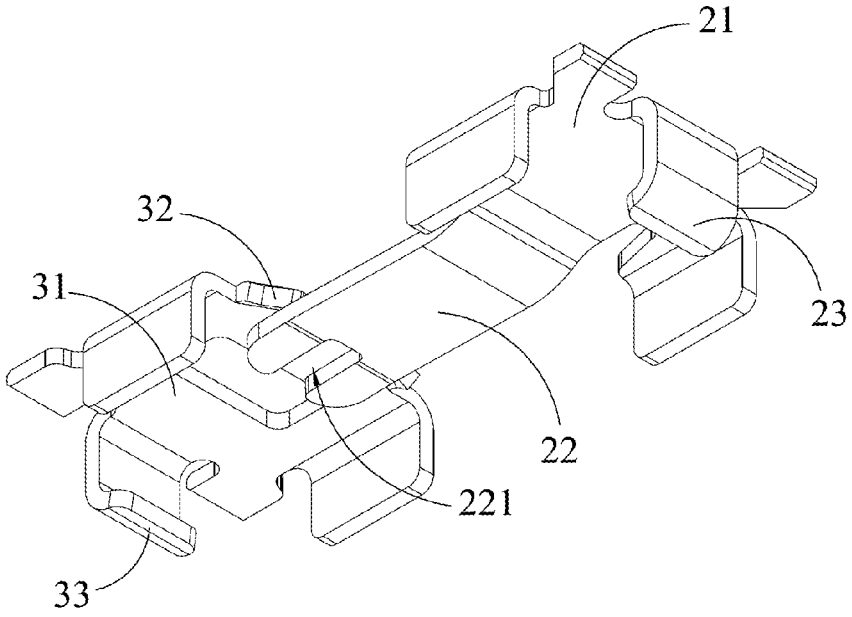
FIG. 3 is a schematic view of organization and shape of the two terminals in the first embodiment.

As illustrated in FIGS. 1-4, a first embodiment of the disclosure mainly includes an insulating case 1, an elastic terminal 2, a fixing terminal 3 and a shielding case 4. The insulating case 1 includes an upper cap 11, a base plate 12 and a connection part 13 that are integrally formed. The upper cap 11 and the base plate 12 of the insulating case 1 are connected by the connection part 13. The upper cap 11 of the insulating case 1 has a convex buckle 111. Corresponding to the convex buckle 111 of the upper cap 11 of the insulating case 1, a notch 121 is set at the edge of the base plate 12 of the insulating case 1. This enables the upper cap 11 of the insulating case 1 to cover the base plate 12 of the insulating case 1 by utilizing the connection part 13 functioned as a hinge, and the upper cap 11 can be fixed on the base plate 12 by matching together the convex buckle 111 of the upper cap 11 and the notch 121 of the base plate 12.

In the first embodiment of the disclosure, the upper cap 11 of the insulating case 1 has an inlet hole 112. A probe E (not shown, referring to the prior art) of a test connector can pass through the inlet hole 112 of the upper cap 11 to enter the insulating case 1, so as to contact the elastic terminal 2 and exchange electrical signals with the elastic terminal 2. An elastic terminal accommodation chamber 122 and a fixing terminal accommodation chamber 123 are arranged on the base plate 12 of the insulating case 1. The elastic terminal accommodation chamber 122 and the fixing terminal accommodation chamber 123 on the base plate 12 are respectively used to accommodate the elastic terminal 2 and the fixing terminal 3, such that at least one part of the elastic terminal 2 and the fixing terminal 3 is stably held inside the insulating case 1.

The elastic terminal 2 has a main part 21. An elastic arm 22 and a weld part 23 respectively extend from the end edges of the main part 21 of the elastic terminal 2. The main part 21 of the elastic terminal 2 is accommodated in the elastic terminal accommodation chamber 122 on the base plate 12 of the insulating case 1. The elastic arm 22 of the elastic terminal 2 is a long cantilever extending from the main part 21 of the elastic terminal 2, which causes a certain amount of elastic deformation to the elastic arm 22 of the elastic terminal 2 when the elastic arm 22 is subjected to an external force. The weld part 23 of the elastic terminal 2 extends out of the insulating case 1, such that the elastic terminal 2 can be electrically connected to a circuit board (not shown) outside the insulating case 1 via the weld part 23.

The fixing terminal 3 also has a main part 31. A fixing arm 32 and a weld part 33 respectively extend from end edges of the main part 31 of the fixing terminal 3. The main part 31 of the fixing terminal 3 is accommodated in a fixing terminal accommodation chamber 123 on the base plate 12 of the insulating case 1. The fixing arm 32 of the fixing terminal 3 is a short cantilever extending from the main part 31 of the fixing terminal 3, which causes a relatively small amount of elastic deformation to the fixing arm 32 of the fixing terminal 3 when the fixing arm 32 is subjected to an external force. The weld part 33 of the fixing terminal 3 extends out of the insulating case 1, such that the fixing terminal 3 can be electrically connected to a circuit board (not shown) outside the insulating case 1 via the weld part 33.

As illustrated in FIG. 2, FIG. 3, FIG. 4, and FIG. 4A, a free end of the elastic arm 22 of the elastic terminal 2 is pressed against the lower edge of the fixing arm 32 of the fixing terminal 3, such that the elastic terminal 2 can be normally electrically connected with the fixing terminal 3. A cutting gap 221 is set at the free end of the elastic arm 22 of the elastic terminal 2. The cutting gap 221 runs through the elastic arm 22 along the direction of the material width of the elastic arm 22, and the cutting gap 221 of the elastic terminal 2 may extend a certain distance from the free end of the elastic arm 22 of the elastic terminal 2 towards the main part 21. A free end of the fixing arm 32 of the fixing terminal 3 has a part slightly convex in size, such that a gap is formed between the free end of the elastic arm 22 of the elastic terminal 2 and the free end of the fixing arm 32 of the fixing terminal 3 to reduce the contact area therebetween. When ambient extraneous matters drop from the inlet hole 112 of the insulating case 1 into the connector, the ambient extraneous matters may drop from the gap between the elastic arm 22 and the fixing arm 32 or from the cutting gap 221 of the elastic arm 22. At the same time, the electrical connection status between the elastic terminal 2 and the fixing terminal 3 can be retained. Since the slightly convex part at the free end of the fixing arm 32 of the fixing terminal 3 is beneficial for increasing the gaps between the elastic arm 22 and the fixing arm 32, it helps to remove the ambient extraneous matters from the elastic arm 22 and the fixing arm 32. However, an equivalent result can also be achieved by only properly increasing the size of the cutting gap 221 of the elastic terminal 2. Therefore, the practical implementation of this embodiment is not necessarily conditioned on that the free end of the fixing arm 32 should have a convex portion.

In the aforesaid first embodiment of the disclosure, since the main part 21 of the elastic terminal 2 is assembled in the elastic terminal accommodation chamber 122 of the insulating case 1, the insulating case 1 has an obvious terminal accommodation chamber 122. For the main part 21 of the elastic terminal 2, if plastic materials are directly formed on the profile of the main part 21 of the elastic terminal 2 by methods such as insert molding, the insulating case 1 would not have the obvious terminal chamber 122, and instead, the materials forming the insulating case 1 would wrap part of the profile of the main part 21 of the elastic terminal 2. Although the insert molding method refers to using the plastic materials of the insulating case 1 to wrap the main part 21 of the elastic terminal 2, when removing the plastic materials of the insulating case 1 by a plastic deformation manner and taking out the main part 21 of the elastic terminal 2, a space capable of accommodating the main part 21 of the elastic terminal 2 is still exposed on the insulating case 1. According to the aforesaid description, in the disclosure and claims, the so-called "elastic terminal accommodation chamber" 122 of the insulating case refers to the space on the insulating case 1 capable of accommodating the main part 21 of the elastic terminal 2. Similarly, in the disclosure and claims, the so-called "fixing terminal accommodation chamber" 123 of the insulating case 1 refers to the space on the insulating case 1 capable of accommodating the main part 31 of the fixing terminal 3.

Figure 5:
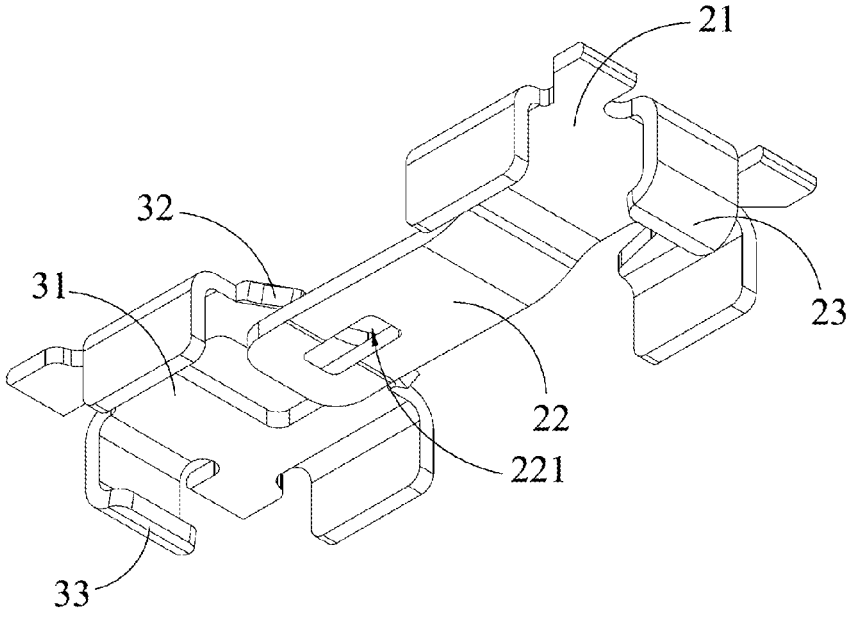
FIG. 5 is a schematic view of organization and shape of two terminals of a second embodiment.
Figure 4:
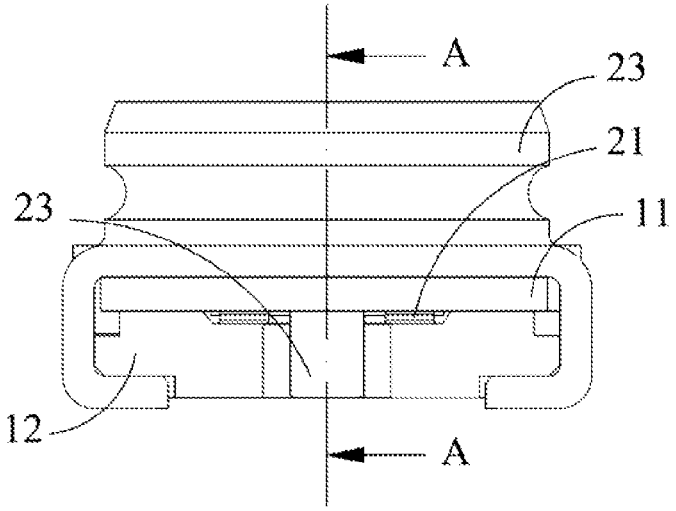
FIG. 4 is a front view of FIG. 1.
Figure 4A:
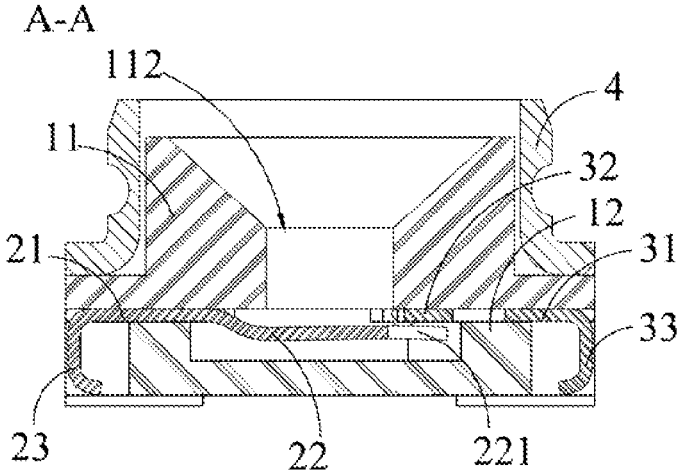
FIG. 4A is a cross-sectional view of FIG. 4 along a cutting line AA.
Figure 6:
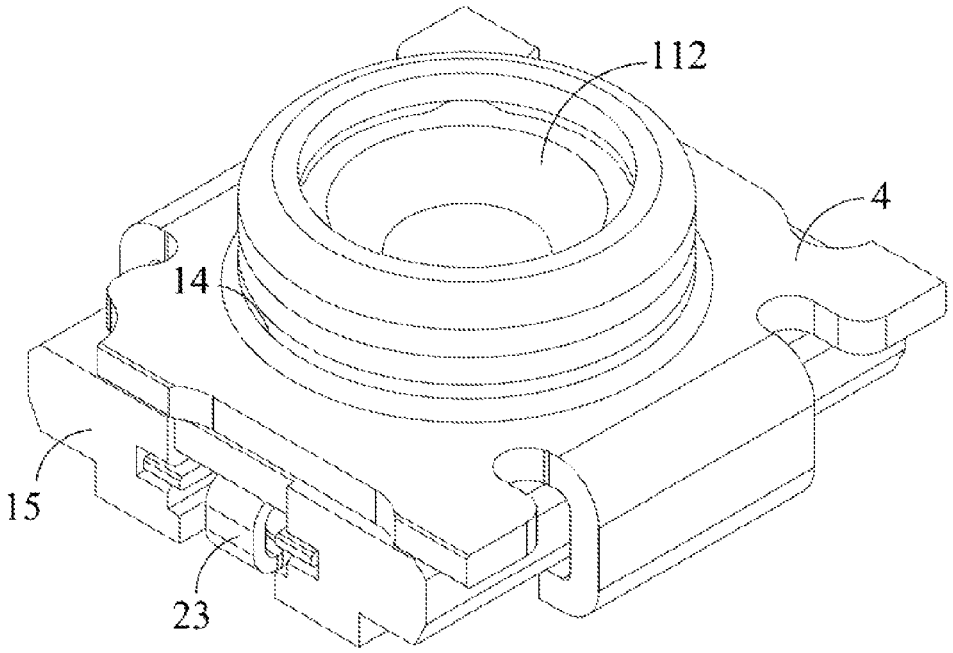
FIG. 6 is a perspective appearance view of a third embodiment of the disclosure.
Figure 6A:
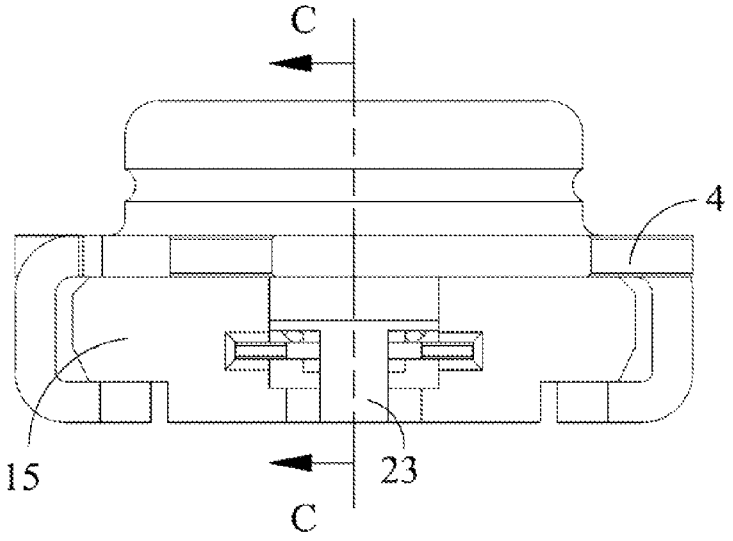
FIG. 6A is a front view of FIG. 6.
Figure 6B:
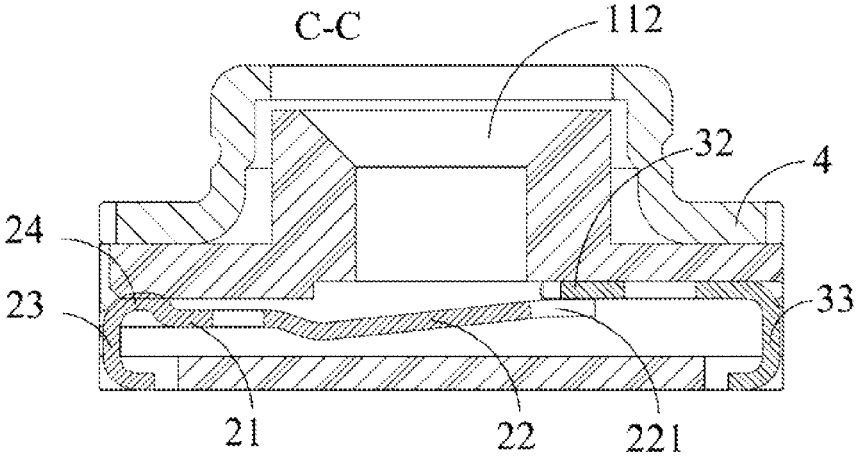
FIG. 6B is a cross-sectional view of FIG. 6A along a cutting line C-C.
Figure 6C:
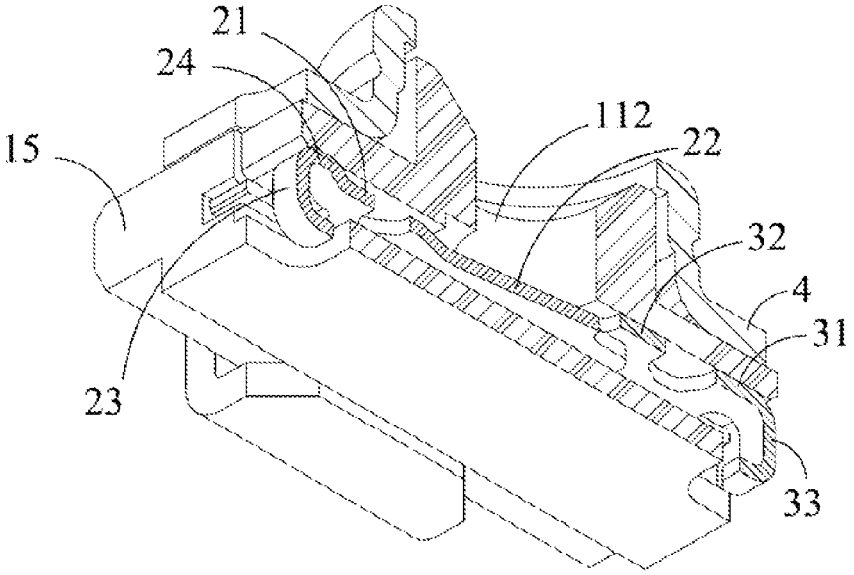
FIG. 6C is a perspective auxiliary view of FIG. 6A along the cutting line C-C.

As illustrated in FIG. 5, in a second embodiment of the disclosure, different from the aforesaid first embodiment of the disclosure and its variation, the cutting gap 221 of the elastic arm 22 of the elastic terminal 2 is not directly set at a contour end of the elastic arm 22, but is set with a certain distance from the contour end of the elastic arm 22. Although the cutting gap 221 of the elastic terminal 2 is set with a certain distance from the free end of the elastic arm 22 of the elastic terminal 2, the cutting gap 221 is still able to remove the ambient extraneous matters, even if the ambient extraneous matters cannot be removed from the cutting gap 221 of the elastic terminal 2 due to the oversize thereof. However, during the test, when the butting connector or the test probe (both not shown) presses down the elastic arm 22 of the elastic terminal 2, the ambient extraneous matters may also slip away along the cutting gap 221 of the elastic arm 22 of the elastic terminal 2.

As illustrated in FIG. 6, FIG. 6A, FIG. 6B and FIG. 6C, in the third embodiment of the disclosure, a surface of the insulating case 1 having the inlet hole 112 is regarded as a first surface 14. On a second surface 15 and a fourth surface 17 of the insulating case 1 (referring to FIG. 7A), an elastic terminal accommodation chamber 122 and a fixing terminal accommodation chamber 123 respectively extend towards the inlet hole 112 on the first surface 14 in order to respectively accommodate the elastic terminal 2 and the fixing terminal 3. The elastic terminal accommodation chamber 122 and the fixing terminal accommodation chamber 123 are respectively communicated with the inlet hole 112. The elastic arm 22 of the elastic terminal 2 elastically contacts the fixing arm 32 of the fixing terminal 3, such that a normal electrical connection status between the elastic terminal 2 and the fixing terminal 3 is formed. Once the elastic arm 22 of the elastic terminal 2 elastically deforms due to a force, the elastic arm 22 of the elastic terminal 2 and the fixing arm 32 of the fixing terminal 3 are disconnected, which causes a temporary circuit break status between the elastic terminal 2 and the fixing terminal 3. Meanwhile, the free end of the elastic arm 22 of the elastic terminal 2 pressed against the fixing arm 32 of the fixing terminal 3 has a cutting gap 221.

Since the electrical signal switch connectors disclosed in embodiments of the disclosure are all tiny-sized connectors, each part of the connector is tiny-sized as well, including the size of a retaining part of the insulating case 1 for retaining the elastic terminal 2. The "retaining" refers to either the interference retaining disclosed in accompanying drawings of the disclosure or the insert molding retaining that may easily come into minds of those skilled in the art. Therefore, when the end of the elastic arm 22 of the elastic terminal 2 with a relatively large size is subjected to a force, the retaining part with relatively small size of the elastic terminal 2 generates a phenomenon similar to rotating axis, causing the displacement of the weld part 23 of the elastic terminal 2. The phenomenon becomes more obvious when the degradation happens to rigidity properties of insulation materials after the connector is produced with lead-free welding.

In the third embodiment of the disclosure, between the main part 21 and the weld part 23 of the elastic terminal 2, a projecting part 24 projects toward the elastic terminal accommodation chamber 122 of the insulating case 1. The appearance size of the projecting part 24 of the elastic terminal 2 is utilized to apply a pre-load on the elastic terminal accommodation chamber 122 inside the elastic terminal accommodation chamber 122 of the insulating case 1, such that the projecting part 24 of the elastic terminal 2 forces on the elastic terminal accommodation chamber 122 of the insulating case 1 before the deformation of the elastic arm 22 of the elastic terminal 2 due to a force. In the figures of this embodiment, the projecting part 24 of the elastic terminal 2 is not located in the normal direction of the elastic terminal 2. Therefore, the pre-load that the projecting part 24 of the elastic terminal 2 applied on the elastic terminal accommodation chamber 122 of the insulating case 1 forms a force moment to the elastic terminal 2. In addition, the pre-load increases the force that is constantly applied on the fixing arm 32 of the fixing terminal 3 by the elastic arm 22 of the elastic terminal 2.

A solution provided by the third embodiment of the disclosure for the pivot-like phenomenon of the elastic terminal 2 is: pressing the projecting part 24 of the elastic terminal 2 against the elastic terminal accommodation chamber 122 of the insulating case 1. Therefore, when the end of the elastic arm 22 of the elastic terminal 2 is subjected to a force, the projecting part 24 of the elastic terminal 2 still applies a force on the weld part 23 of the elastic terminal 2 in order to reduce the displacement possibility or amount of the weld part 23 of the elastic terminal 2. Additionally, because of a pre-load that is applied on the elastic terminal accommodation chamber 122 of the insulating case 1 by the projecting part 24 of the elastic terminal 2, when the retaining part of the elastic terminal 2 forms a phenomenon similar to rotating axis, the force moment formed from the pre-load corresponding to the elastic terminal 2 exactly makes the end of the elastic arm 22 of the elastic terminal 2 normally and tightly press against the fixing arm 32 of the fixing terminal 3. Since the positive force applied on the fixing arm 32 of the fixing terminal 3 by the elastic arm 22 of the elastic terminal 2 (i.e., the force generated for the elastic arm 22 of the elastic terminal 2 tightly pressing against the fixing arm 32 of the fixing terminal 3) has an obvious affect on the overall impedance property of the connector, the size of the projecting part 24 of the elastic terminal 2 is in relation to the pre-load applied on the elastic terminal accommodation chamber 122 by the elastic terminal 2. That is, the size of the projecting part 24 of the elastic terminal 2 is associated with the overall impedance property of the connector.

Figure 7:
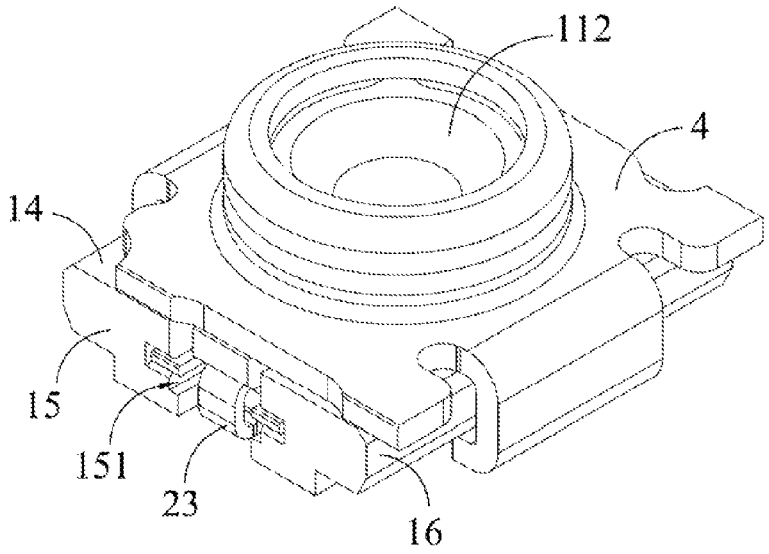
FIG. 7 is a perspective appearance view of a fourth embodiment of the disclosure.
Figure 7A:
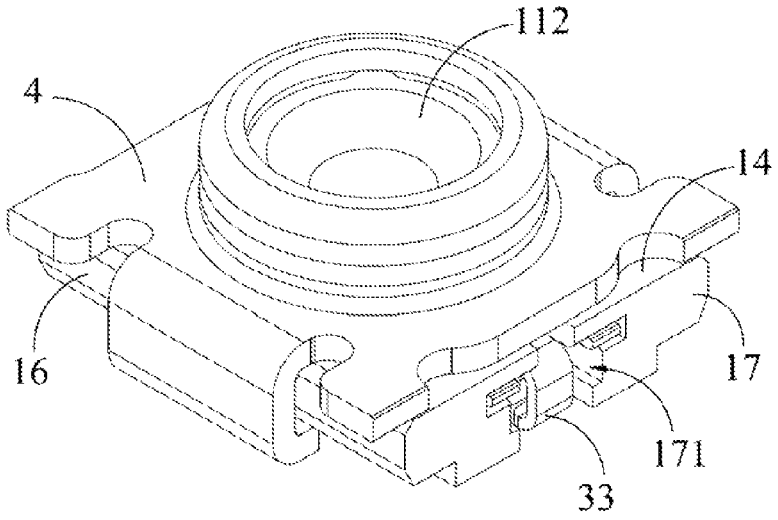
FIG. 7A is a perspective appearance view, from another viewing angle, of the fourth embodiment of the disclosure.
Figure 7B:
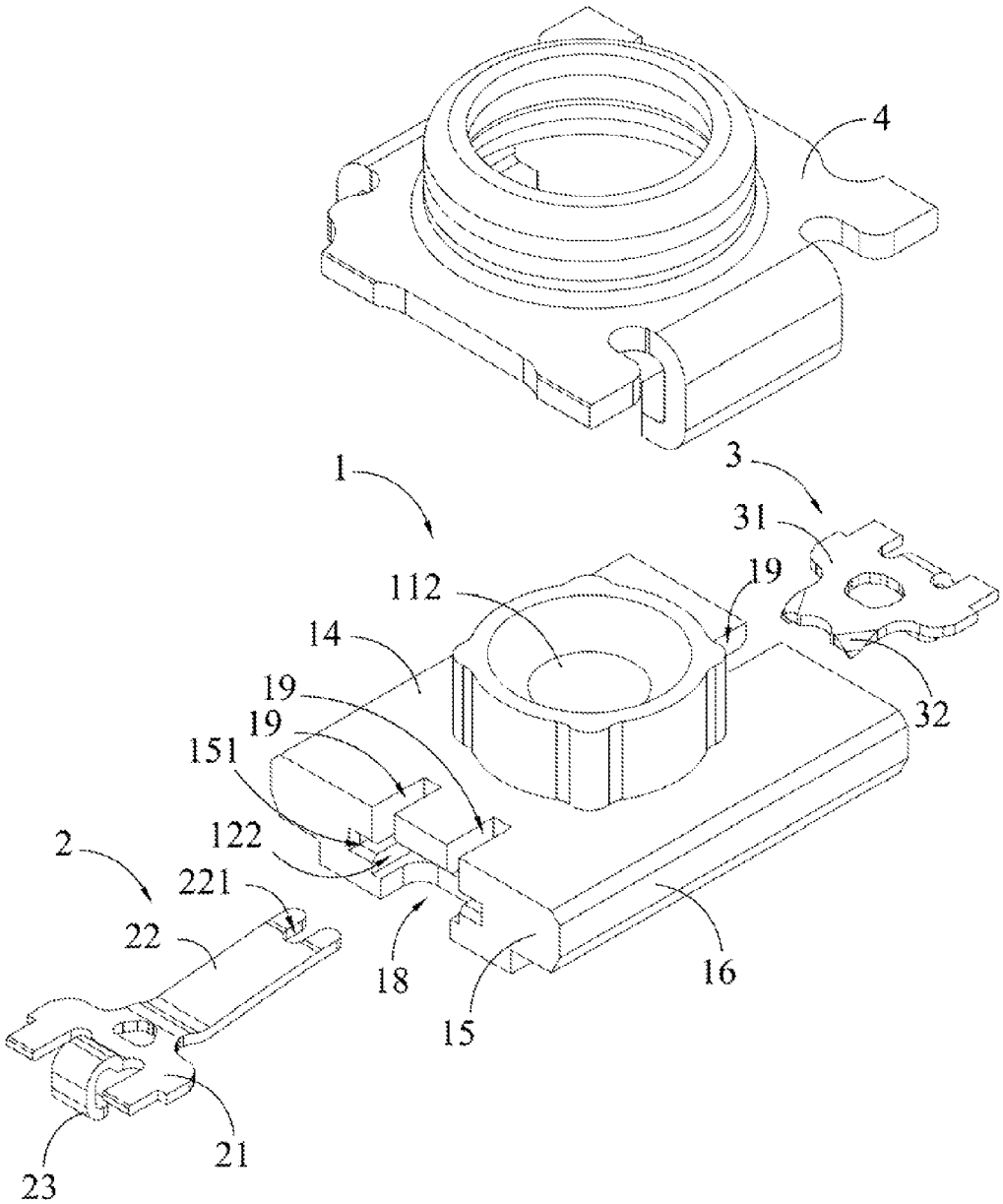
FIG. 7B is an exploded view of FIG. 7.

As illustrated in FIG. 7, FIG. 7A and FIG. 7B, the insulating case 1 in the fourth embodiment of the disclosure at least has a first surface 14, a second surface 15, a third surface 16 and a fourth surface 17 within the three-dimensional space, wherein a surface of the insulating case 1 having the inlet hole 112 is regarded as the first surface 14, and the first surface 14 is adjacent to the second surface 15, the third surface 16 and the fourth surface 17 at the same time, with the second surface 15 not adjacent to the fourth surface 17. A first opening 151 and a second opening 171 are respectively arranged on the second surface 15 and the fourth surface 17. In addition, an elastic terminal accommodation chamber 122 and a fixing terminal accommodation chamber 123 respectively extend from the first opening 151 and the second opening 171 on the second surface 15 and the fourth surface 17 toward the inlet hole 112 on the first surface 14, so as to respectively accommodate the elastic terminal 2 and the fixing terminal 3. The elastic terminal accommodation chamber 122 and the fixing terminal accommodation chamber 123 are respectively communicated with the inlet hole 112. The elastic arm 22 of the elastic terminal 2 elastically contacts the fixing arm 32 of the fixing terminal 3 such that a normal electrical connection status between the elastic terminal 2 and the fixing terminal 3 is formed. Once the elastic arm 22 of the elastic terminal 2 deforms due to a force, the elastic arm 22 of the elastic terminal 2 and the fixing arm 32 of the fixing terminal 3 are disconnected, which causes a temporary circuit break status between the elastic terminal 2 and the fixing terminal 3. Meanwhile, the free end of the elastic arm 22 of the elastic terminal 2 pressed against the fixing arm 32 of the fixing terminal 3 has a cutting gap 221.

Figure 8A:
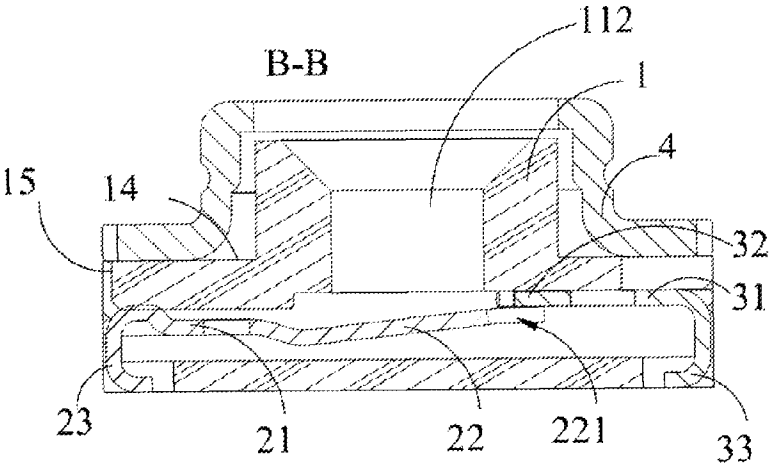
FIG. 8A is a cross-sectional view of FIG. 8 along a cutting line B-B.
Figure 8:
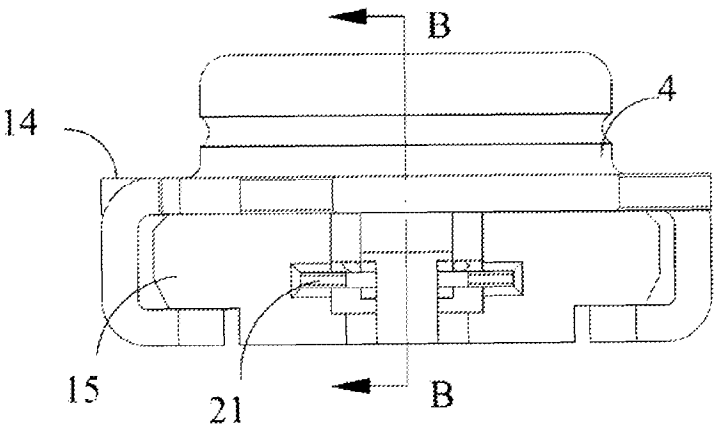
FIG. 8 is a front view of FIG. 7.
Figure 9:
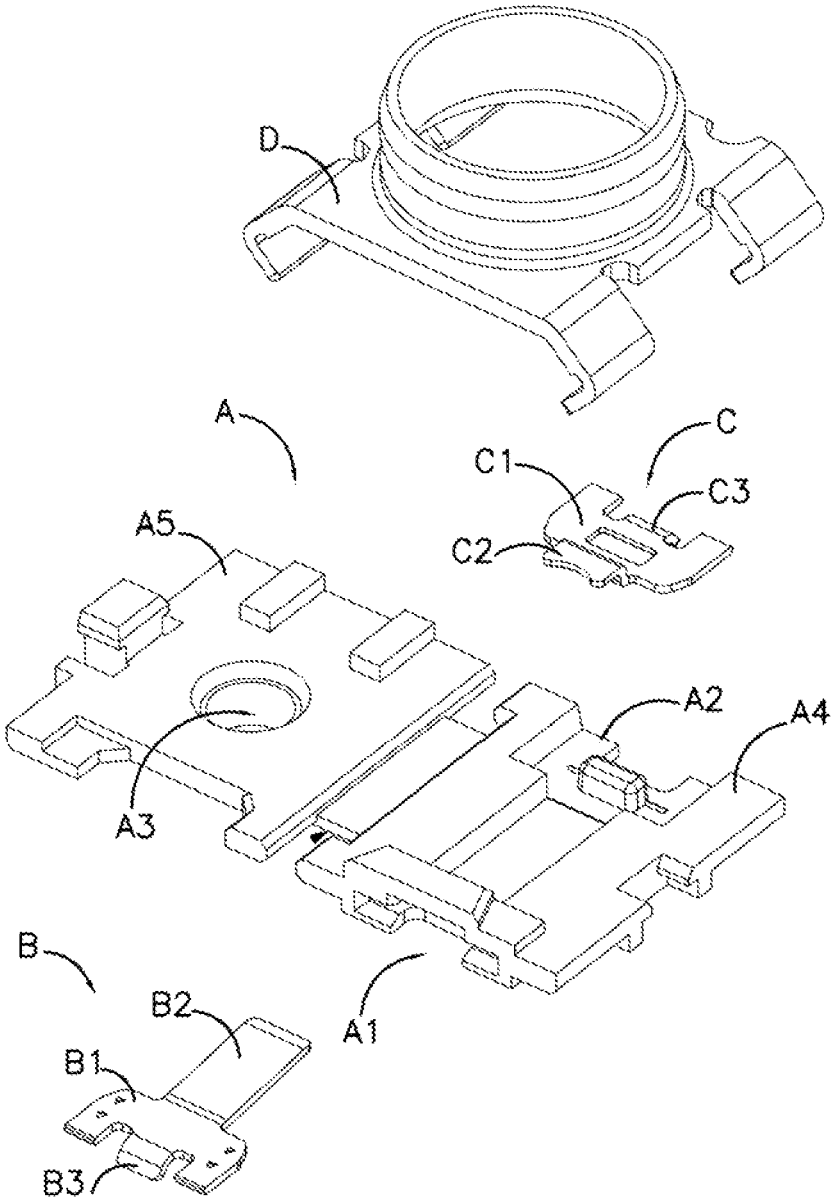
FIG. 9 ( PRIOR ART )
FIG. 9 is an exploded view of Taiwan Utility Model Patent No. M336603 of the prior art.
Figure 9A:
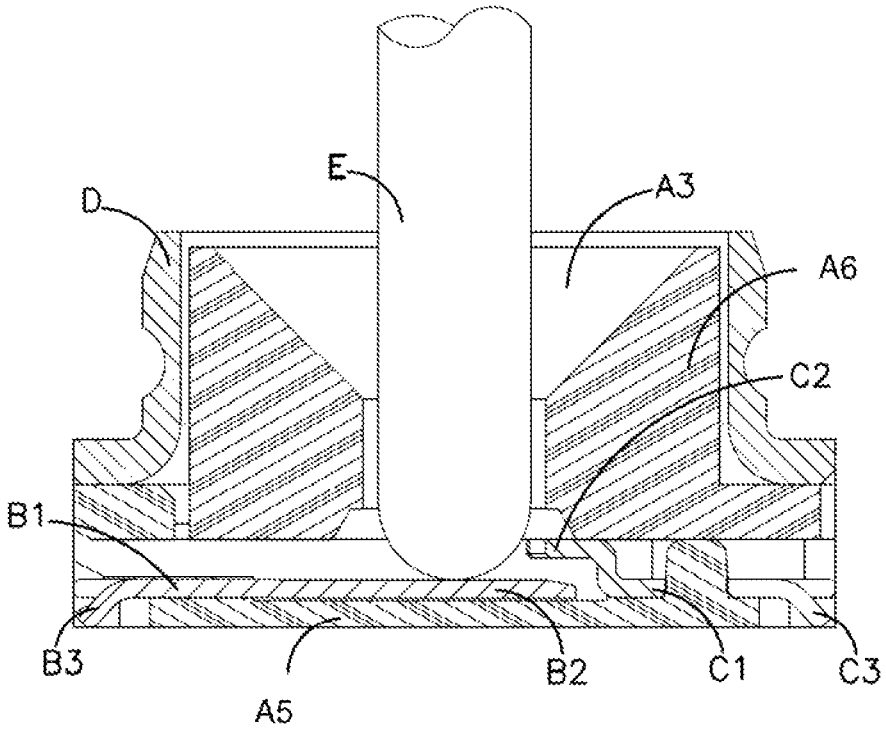
FIG. 9A ( PRIOR ART )
FIG. 9A is a schematic cross-sectional view of FIG. 9.
Figure 10:
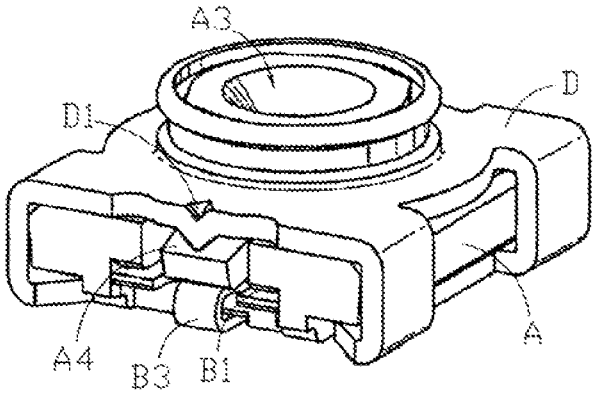
FIG. 10 ( PRIOR ART )
FIG. 10 is a perspective appearance view of Taiwan Invention Patent Publication No. TW201036284 of the prior art.
Figure 10A:
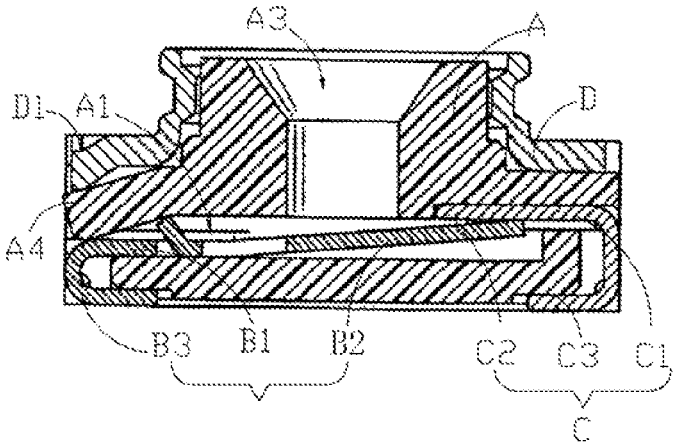
FIG. 10A ( PRIOR ART )
FIG. 10A is a cross-sectional view of FIG. 10.

As illustrated in FIG. 8 and FIG. 8A, in the fourth embodiment, for reducing precious surface area of the circuit board (not shown) occupied by the connector, a notch 18 is set on the insulating case 1 at each place corresponding to the weld parts 23 and 33 of the elastic terminal 2 and the fixing terminal 3, such that the weld parts 23 and 33 of the elastic terminal 2 and the fixing terminal 3 can be respectively accommodated in notches 18. In addition, the weld parts 23 and 33 of the elastic terminal 2 and the fixing terminal 3 can be electrically connected respectively with circuits on the circuit board. Because of each notch 18 of the insulating case 1, when the elastic terminal 2 and the fixing terminal 3 are enclosed into the elastic terminal accommodation chamber 122 and the fixing terminal accommodation chamber 123, a supporting force at the bottom of the elastic terminal 2 is decreased; and for the elastic arm 22 of the elastic terminal 2 and the fixing arm 32 of the fixing terminal 3, the weld part 23 of the elastic terminal 2 may droops, which may generates a defect that the weld parts 23 and 33 of the elastic terminal 2 and the fixing terminal 3 are not co-planar.

Although a solution for solving the defect can be easily implemented by: changing an angle of the elastic terminal 2 assembled into the elastic terminal accommodation chamber 122 of the insulating case 1 such that the elastic terminal 2 and the fixing terminal 3 can be subjected to a deformation pre-load when being assembled into the elastic terminal accommodation chamber 122 and the fixing terminal accommodation chamber 123 of the insulating case 1. However, it is insufficient to only apply the pre-load on the elastic terminal 2 and the fixing terminal 3. During the heating process when welding onto the circuit board (not shown the pre-load may lead to displacement of the elastic terminal 2 or the fixing terminal 3 relative to the insulating case 1.

Another solution provided in this embodiment is: setting up an inlet ditch 19 at places of the insulating case 1 corresponding to each notch 18, and reducing the structure strength near each inlet ditch 19 of the insulating case 1 by the setting up of each inlet ditch 19, such that the relative displacement would not happen to the elastic terminal 2 or the fixing terminal 3 when the insulating case 1 is being heated.

Although the disclosure has been disclosed with reference to the above embodiments, these embodiments are not intended to limit the disclosure. It will be apparent to those skilled in the art that various modifications and variations can be made without departing from the scope or spirit of the disclosure. Therefore, the scope of the disclosure shall be defined by the appended claims.

What is claimed is:

1. An electrical signal switch connector structure, mainly comprising an insulating case, an elastic terminal, a fixing terminal and a shielding case, wherein the insulating case has an elastic terminal accommodation chamber, a fixing terminal accommodation chamber, and an inlet hole; wherein the elastic terminal accommodation chamber and the fixing terminal accommodation chamber of the insulating case respectively accommodate the elastic terminal and the fixing terminal; wherein the elastic terminal has an elastic arm, and the fixing terminal has a fixing arm; wherein the elastic arm of the elastic terminal is elastically pressed against the fixing arm of the fixing terminal; wherein the elastic terminal and the fixing terminal respectively have a weld part; wherein the weld parts of the elastic terminal and the fixing terminal respectively extend out of the insulating case; wherein the inlet hole of the insulating case is configured for passing through part of a butting connector; and wherein the shielding case wraps the profile of the insulating case, which is characterized in that: the elastic arm of the elastic terminal has a free end with a cutting gap, and the free end is normally pressed against a lower edge of the fixing arm of the fixing terminal, wherein the elastic terminal has a main part, and a projecting part disposed between the main part and the weld part of the elastic terminal projects toward the elastic terminal accommodation chamber of the insulating case to normally apply a pre-load on the elastic terminal accommodation chamber of the insulating case, and wherein the pre-load applied on the elastic terminal accommodation chamber of the insulating case by the elastic terminal makes the elastic terminal be subjected to a force moment, and the force moment forces the free end of the elastic arm of the elastic terminal to further press against the fixing arm of the fixing terminal.

2. The electrical signal switch connector structure of claim 1, wherein the cutting gap of the elastic terminal extends from the free end of the elastic arm.

3. The electrical signal switch connector structure of claim 1, wherein the insulating case has an upper cap and a base plate; wherein the upper cap and the base plate are connected by a connection part; and wherein the upper cap of the insulating case rotates to cover the base plate by using the connection part.

4. The electrical signal switch connector structure of claim 3, wherein the inlet hole of the insulating case is set at the upper cap of the insulating case; and wherein the elastic terminal accommodation chamber and the fixing terminal accommodation chamber of the insulating case are set at the base plate of the insulating case.

5. The electrical signal switch connector structure of claim 1, wherein the fixing terminal also has a main part; and wherein the main part of the fixing terminal connects the fixing arm and the weld part of the fixing terminal.

6. The electrical signal switch connector structure of claim 1, wherein the cutting gap of the elastic terminal is located beneath the fixing arm of the fixing terminal.

7. The electrical signal switch connector structure of claim 1, wherein the free end of the fixing arm of the fixing terminal has a convex portion, such that the elastic arm of the elastic terminal and the fixing arm of the fixing terminal have a relatively small contact area.

8. The electrical signal switch connector structure of claim 1, wherein a notch is respectively set up at a surface departing the inlet hole in the elastic terminal accommodation chamber and the fixing terminal accommodation chamber of the insulating case; and wherein each notch of the insulating case respectively accommodate the weld parts of the elastic terminal and the fixing terminal.

9. The electrical signal switch connector structure of claim 8, wherein corresponding to each notch, at least one inlet ditch is respectively set in the elastic terminal accommodation chamber and the fixing terminal accommodation chamber of the insulating case.

10. The electrical signal switch connector structure of claim 1, wherein the elastic arm of the elastic terminal is connected with a main part; and wherein at least part of the main part of the elastic terminal is retained at the insulating case which has an elastic terminal accommodation chamber.

11. The electrical signal switch connector structure of claim 1, wherein the projecting part of the elastic terminal is at least one convex point.

* * * * *